United States Patent [19]

Bienvenu

[11] Patent Number: 4,671,037

[45] Date of Patent: Jun. 9, 1987

[54] ROOF CONSTRUCTION

[76] Inventor: Joseph Bienvenu, 221-8 St., New Westminister, British Columbia, Canada, V3M 3P8

[21] Appl. No.: 872,974

[22] Filed: Jun. 11, 1986

[51] Int. Cl.[4] ..... E04D 1/00

[52] U.S. Cl. ..... 52/526; 52/531; 52/522

[58] Field of Search ..... 52/522, 526, 529, 542, 52/530, 536

[56] References Cited

U.S. PATENT DOCUMENTS

| | | | |
|---|---|---|---|
| 381,318 | 4/1888 | Barker | 52/531 |
| 1,236,510 | 8/1917 | Wales | 52/530 |
| 1,519,350 | 12/1924 | Belding | 52/530 X |
| 2,830,546 | 4/1958 | Rippe | 52/522 |
| 3,188,774 | 6/1965 | McCorkle | 52/522 |
| 3,347,001 | 10/1967 | Cosden | 52/522 |
| 3,559,359 | 2/1971 | Talbert | 52/522 |

FOREIGN PATENT DOCUMENTS

| | | |
|---|---|---|
| 778052 | 2/1968 | Canada . |
| 844260 | 6/1970 | Canada . |
| 957122 | 11/1974 | Canada . |
| 1054330 | 5/1979 | Canada . |

*Primary Examiner*—William F. Pate, III
*Assistant Examiner*—Creighton Smith

[57] ABSTRACT

A roof shingle is provided with upper and lower edges adapted for resilient interlocking with the corresponding lower and upper edges of further such shingles arranged in adjacent rows in a roof construction. The end edges are also provided with lip and slot arrangements to facilitate end-to-end interlocking. One end of each shingle has a projecting tab for nailing to the building, such tab being hidden beneath an adjacent shingle in the finished construction.

4 Claims, 12 Drawing Figures

FIG. 11
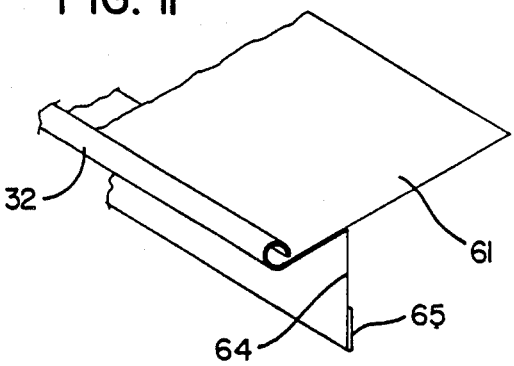
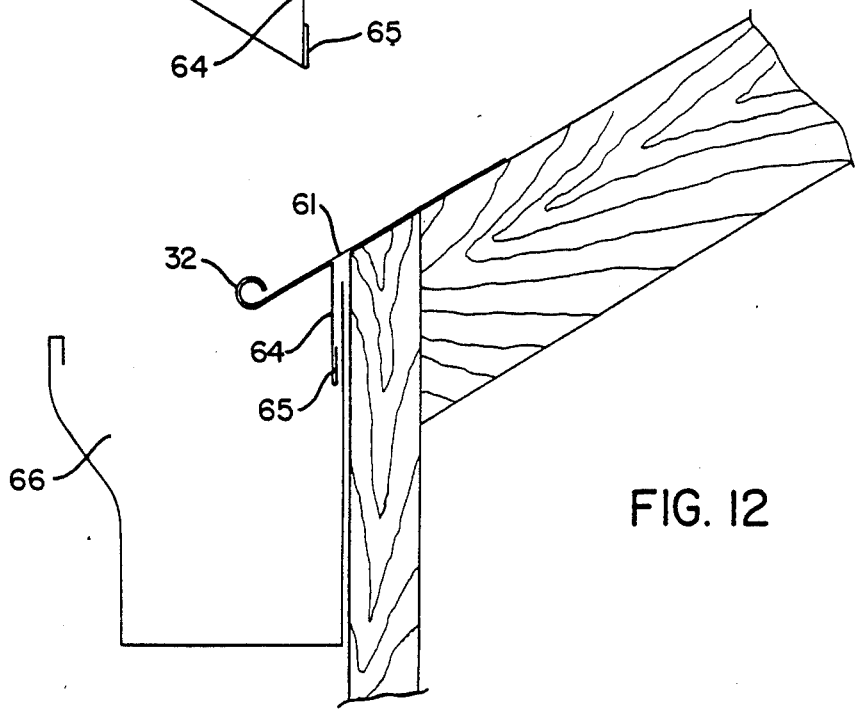
FIG. 12

ROOF CONSTRUCTION

BACKGROUND OF THE INVENTION

This invention relates to roofing panels of the type commonly referred to as shakes or shingles (hereinafter referred to as shingles) and, more particularly, to interlocking shingles made of a bendable, resilient material, such as metal or vinyl, that are more versatile and easier to install than those available hitherto.

PRIOR ART

The present invention is an improvement in the shingles shown in my prior Canadian Pat. No. 844,260 issued June 16, 1970. Other interlocking shingles are disclosed in Canadian Pat. Nos. 778,052 issued Feb. 13, 1968 to M. Wienand; 957,122 issued Nov. 5, 1974 to Thomas R. Pearse, et al and 1,054,330 issued May 15, 1979 to Paul Naz; as well as in U.S. Pat. Nos. 381,318 issued Apr. 17, 1888 to E. E. Barker; 720,893 issued Feb. 17, 1903 to E. G. Charlebois; 1,236,510 issued Aug. 14, 1917 to C. M. Wales; and 1,519,350 issued Dec. 16, 1924 to G. A. Belding.

SUMMARY OF THE INVENTION

The object of the invention is to provide an all purpose shingle, that is to say one that can be used on any roof, regardless of the pitch thereof, and one that can be just as easily installed in a downward direction starting at the top of the roof as in an upward direction starting at the bottom.

The invention also provides shingles having upper and lower edges adapted for resilient interlocking with the corresponding edges of shingles above and below. Provision is also made for interlocking the shingles end-to-end to form rows. One end of each shingle can have a projection tab for nailing to the building, such tab being hidden beneath an adjacent shingle in the finished construction.

BRIEF DESCRIPTION OF THE DRAWINGS

FIG. 11 is a perspective view of a fragment of a gutter member; and

FIG. 12 is a sectional view demonstrating use of this member.

DETAILED DESCRIPTION OF THE PREFERRED EMBODIMENTS

Figure 1:
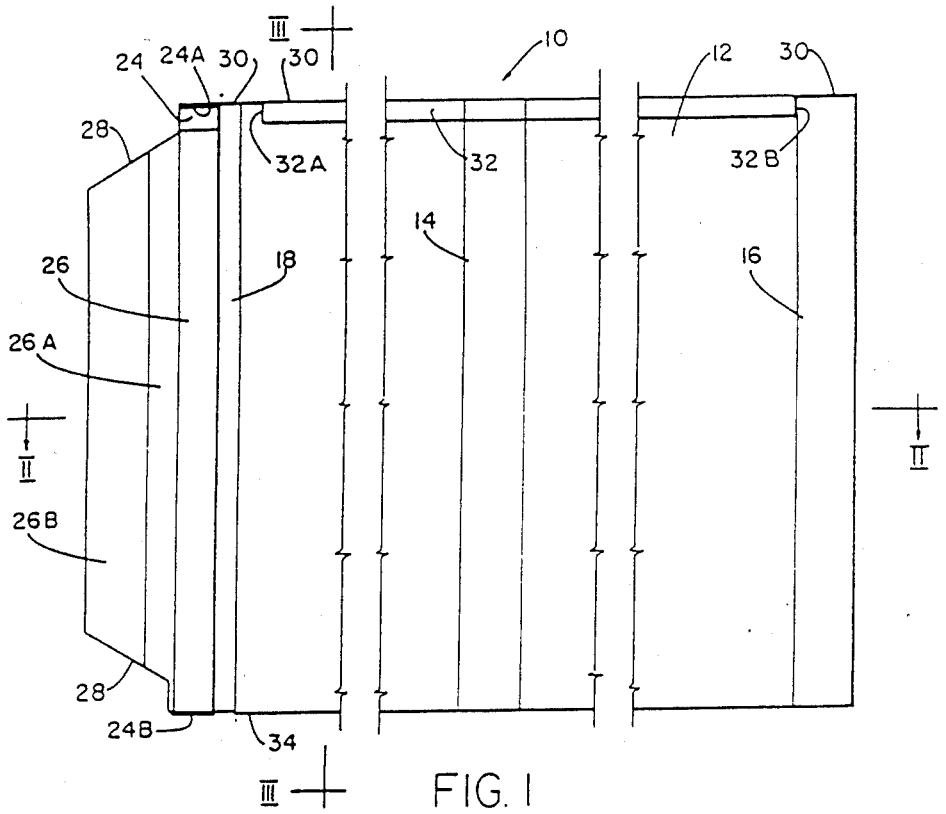
FIG. 1 is a plan view of a shingle according to an embodiment of the present invention.

A shingle 10 as seen in FIGS. 1 to 5 consists of a metal sheet having a rectangular main panel 12 with a slightly raised, strengthening ridge 14 extending down the centre thereof, another slightly raised, strengthening ridge 16 extending down its right hand edge, and a slightly depressed, strengthening ridge 18 extending down its left hand edge. Its right hand edge is bent downwardly and back under the ridge 16 to form a lip 20 defining a slot 22. At its left hand edge, the panel is bent upwardly and back over the ridge 18 at 24, and then bent back on itself and outwardly again at 26 to extend into a downward ramp portion 26A and eventually a projecting tab 26B. The edges of the tab 26B are cut away at 28.

Along its top edge the panel 12 has an upwardly projectinglip 30 (see especially FIG. 3) that extends into an inwardly and downwardly curved rim 32. At each end of the panel the lip 30 remains, but the curved-over rim is cut away, i.e. the rim ends at 32A and 32B. As best seen in FIG. 1, the end 24A of the bent back portion 24 lies against the inner surface of the left hand end of the lip 30.

Figure 2:
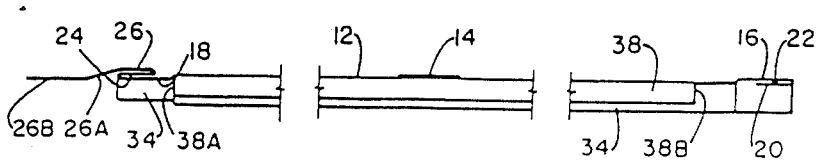
FIG. 2 is a section on the line II—II in FIG. 1.

Along its lower edge, the panel 12 has a downwardly projectinglip 34 (FIG. 3) that is bent back on itself at 36, the flat portion 36 extending into an inwardly and downwardly curved portion 38 that defines a groove 40. While the lip 34 extends the full length of the panel 12, the portions 36 and 38, and hence the groove 40, terminate at 38A and 38B (FIG. 2).

At the lower left hand corner of each shingle, as seen in FIG. 1, the end 24B of the portion 24 lies against the outer surface of the lip 34.

Figures 3, 6, 7:
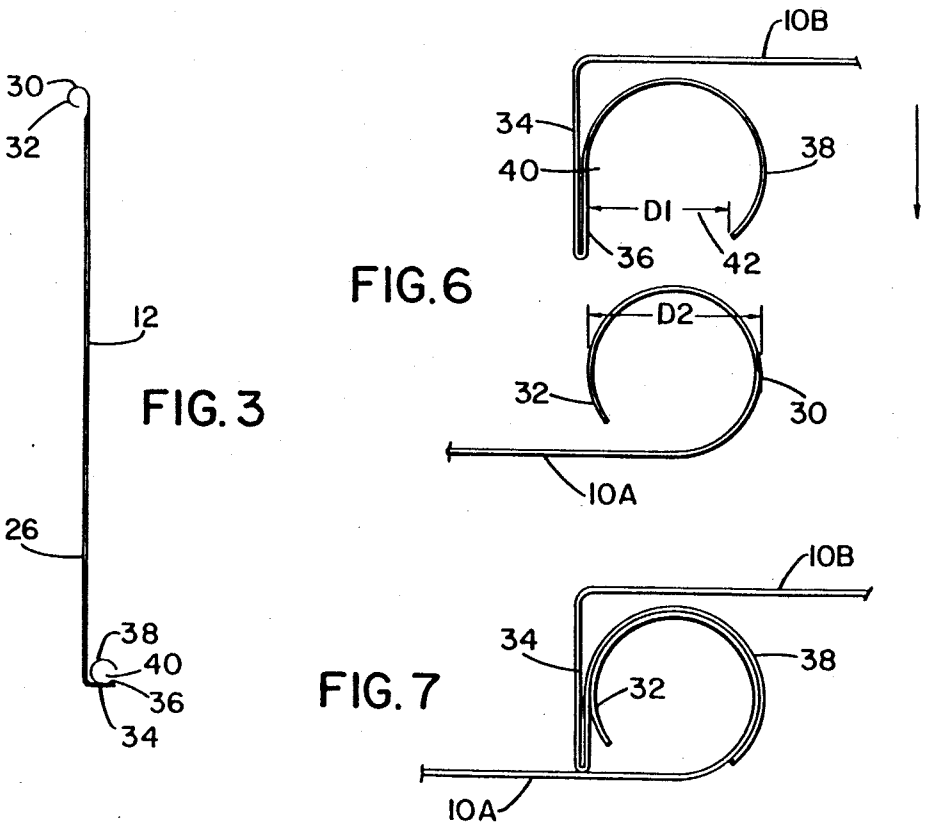
FIG. 3 is a section on the line III—III in FIG. 1.
FIG. 6 is a fragmentary view of portions of two such shingles arranged one above the other and in position for engagement with each other.
FIG. 7 is a view corresponding to FIG. 6 demonstrating the manner in which these two shingles can be interlocked with each other along their respective top and bottom edges.
Figure 4:
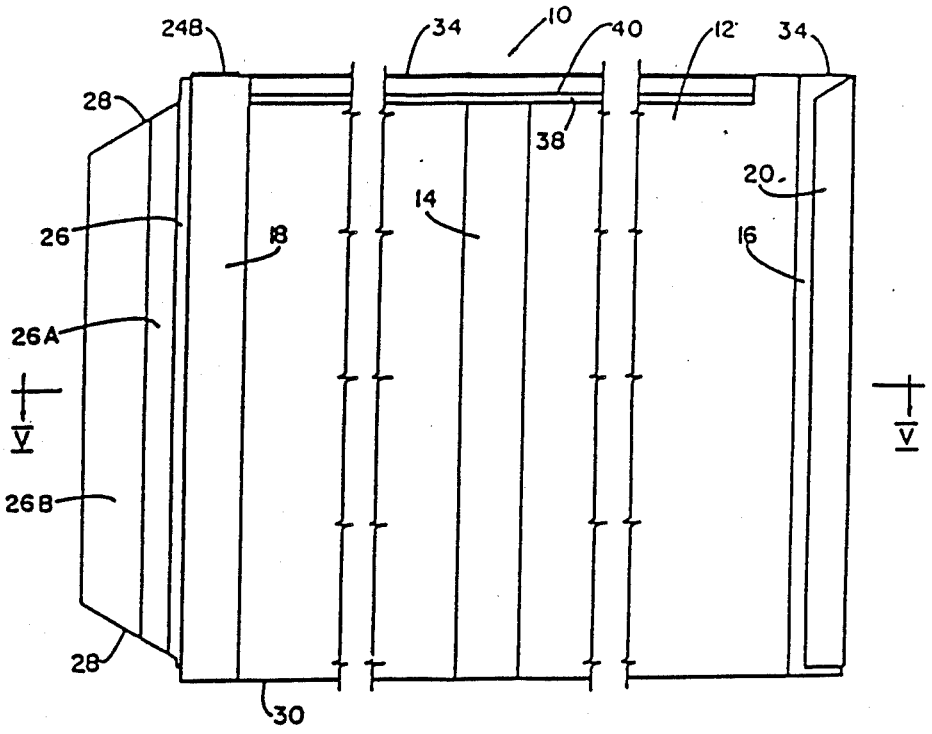
FIG. 4 is an underside view of the shingle of FIG. 1.
Figure 5:
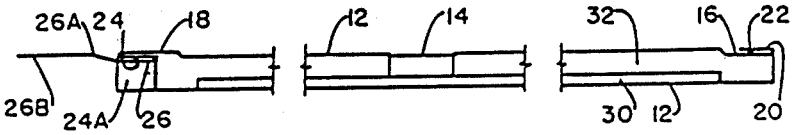
FIG. 5 is a section on V—V in FIG. 4.

The shape of the groove 40 is such (see especially FIGS. 6 and 7), i.e. with a mouth 42 of restricted width D1, that the rim 32 of one shingle 10A (width D2 slightly greater than D1) can be snapped resiliently into place and retained in the groove 40 of an adjacent shingle 10B, as shown in FIG. 7. In this manner, the bottom edge of one shingle 10B can be firmly interlocked with the upper edge of an adjacent shingle 10A.

Figure 9:
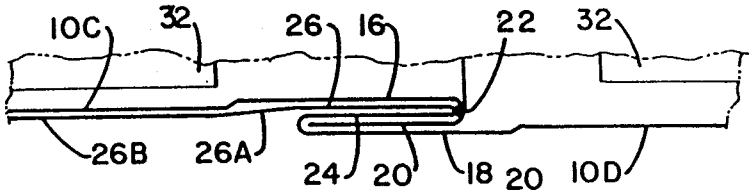
FIG. 9 is a section on IX—IX in FIG. 8.
Figure 8:
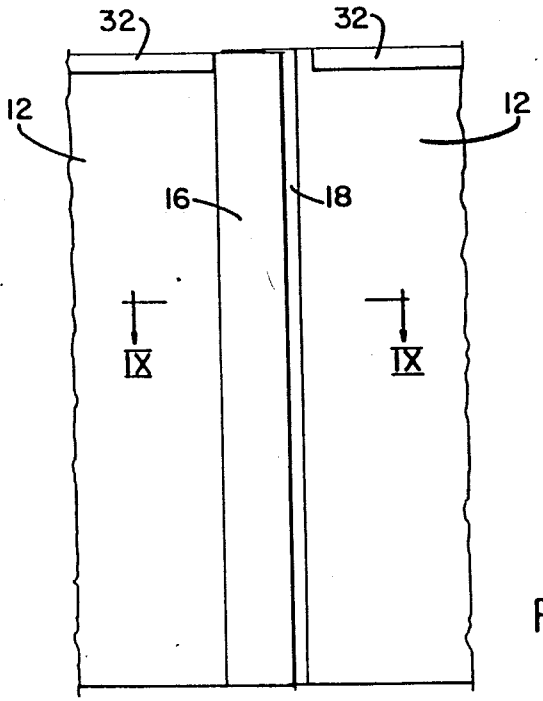
FIG. 8 is a fragmentary plan view demonstrating the interlocking of two shingles along their end edges.

FIGS. 8 and 9 show the end-to-end interlocking of a pair of such shingles, here designated 10C and 10D, the lip 20 on the right hand end of the shingle 10C engaging in the space between the bent parts 18 and 24 of the shingle 10D, while the bent parts 24 and 26 of the shingle 10D engage the slot 22 defined between the lip 20 and the ridge 18 of the shingle 10C. While FIG. 9 appears to show these engagements loose to facilitate the drawing, the parts actually engage each other snuggly and firmly.

Figure 10:
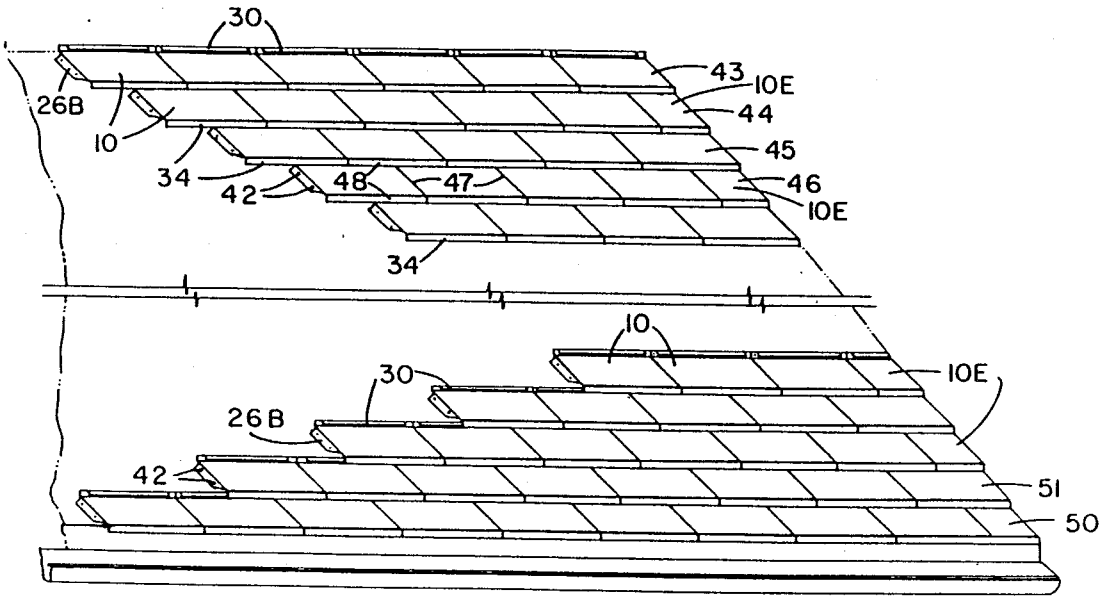
FIG. 10 is a diagrammatic view of a partly constructed roof, demonstrating two ways in which a number of such shingles can be assembled both along their top and bottom edges and along their end edges.

FIG. 10 demonstrates two ways in which a roof can be constructed from a number of such shingles. The upper part of FIG. 10 illustrates a partially constructed roof installed downwardly from the top of the roof. Each shingle 10 is fixed by nails 42 driven through its projecting tab 26B into sheeting (not shown) or rafters or other structural members of the house frame. Starting at the top right hand corner and working to the left and downwardly, rows 43, 44, 45, 46 etc. of shingles 10 are nailed in place while being interlocked with their neighbours in the manner illustrated in FIGS. 6–9, namely end-to-end to form joints 47 and along their top and bottom edges to form joints 48. Half length shingles 10E will be required along the edges. To enable the top and bottom rim and groove interlock to be snapped into engagement, the lower edges of the shingles of one row will be raised slightly while the upper edges of the shingles in the next row below are moved into place. Then the lower edges of the shingles of the upper row will then be forced down and snapped into interlocking engagement with the upper edges of the shingles of the row below. This operation will be coordinated with assembly from right to left, since each tab 26B needs to be nailed in place before it is covered by the shingle next to its left, the shingle ends being interlocked as shown in FIGS. 8 and 9. In the finished construction a ridge cap (not shown) will be fixed in place along the top edge.

As shown in the lower part of FIG. 10, when assembling the roof from the lower edge upwards, the lowermost row 50 of shingles 10 is mounted and secured in place, followed by the second row 51, and so on, the top and bottom edges being snapped into place as before and the ends interlocked after each tab 26B has been nailed in place.

FIGS. 11 and 12 show a starter strip comprising a downwardly inclined main panel 61 bent twice along its lower edge to form a gutter 62 and extending back up at 63 beneath the panel 61 and finally vertically downwardly at 64 to an upwardly bent end 65. FIG. 11 shows the arrangement of this strip 60 relative to the building and to a main eavestrough 66. The upper edge of this strip is formed with an upwardly rolled rim 32 constructed in the same manner as the upper edges of the shingles 10 whereby to form a rim with which the lower edges of the first row of shingle can be interlocked.

FIG. 13 shows how lower shingles 10F approaching a valley between two roofs are interconnected by a member 70 which is nailed to the building and has a gutter portion 71 that extends on both sides to form a bent-over lip 72 that accommodates a lower edge curved portion 38 of each shingle.

I claim:

1. A roof shingle of a bendable, resilient, sheet material comprising (a) a rectangular, generally planar, main portion having parallel upper and lower edges, (b) an upwardly projecting first lip extending along said upper edge, said lip extending into an inwardly and downwardly curved rim, and (c) a downwardly projecting second lip extending along said lower edge, said second lip being bent back on itself to project upwardly and then extending into an inwardly and downwardly curved portion that defines a groove the shape of which complements that of the rim, said groove having an interior and a mouth slightly narrower that the width of said interior and the width of the rim whereby the rim of a second said shingle can be snapped reseliently into place into the interior fof the groove and retained therein to firmly interlock the two shingles along their respective upper and lower edges by relative movement between the two shingles when their main portions lie in generally parallel planes to each other and such movement takes place in a direction generally perpendicular to said planes.

2. A shingle according to claim 1 having parallel end edges and including (d) a third lip bent downwardly and back on the main portion while extending along one of said end edges to form an end slot, and (e) a fourth lip bent upwardly and back on the main portion while extending along the other end edge, said fourth lip being shaped to firmly engage in the end slot of a further said shingle for interlocking the two shingles along their respective end edges.

3. A shingle according to claim 2, wherein (f) said fourth lip is still further bent upwardly and back on itself to extend outwardly from the main portion and form an end tab for nailing to a building member.

4. A shingle according to claim 3, wherein (g) at an end of said upper edge adjacent the fourth lip, said first lip has a portion that terminates after projecting upwardly without extending into said curved ring, and (h) said fourth lip has an end extension that projects to said portion of first lip and extends up said portion adjacent and parllel thereto.

* * * * *